US005704450A

United States Patent [19]

Lunceford

[11] Patent Number: 5,704,450

[45] Date of Patent: Jan. 6, 1998

[54] PORTABLE AND FOLDABLE WORKHORSE

[76] Inventor: Harvey Lunceford, Rt. 4, Box 1285, Stigler, Okla. 74462

[21] Appl. No.: 529,921

[22] Filed: Sep. 18, 1995

[51] Int. Cl.[6] ..... B27B 21/00

[52] U.S. Cl. ..... 182/153; 182/225; 182/181.1

[58] Field of Search ..... 182/153–155, 182/181–186, 224–227

[56] References Cited

U.S. PATENT DOCUMENTS

| | | | |
|---|---|---|---|
| 889,494 | 6/1908 | Van Halder | 182/155 |
| 1,435,738 | 11/1922 | Reiman . | |
| 1,611,376 | 12/1926 | Reiman | 182/155 |
| 2,216,187 | 10/1940 | Dion | 304/5 |
| 2,828,165 | 3/1958 | Harter | 304/5 |
| 2,905,263 | 9/1959 | Andersson | 182/154 |
| 4,605,099 | 8/1986 | Crum et al. | 182/155 |
| 4,756,386 | 7/1988 | Blanchard | 182/153 |
| 4,790,411 | 12/1988 | Ottoson | 182/153 X |
| 4,926,966 | 5/1990 | Boudreau | 182/155 |
| 5,215,162 | 6/1993 | Parks et al. | 182/153 |

FOREIGN PATENT DOCUMENTS

| | | | |
|---|---|---|---|
| 253664 | 11/1991 | Japan | 182/184 |
| 2038172 | 7/1980 | United Kingdom | 182/155 |

*Primary Examiner*—Alvin C. Chin-Shue
*Attorney, Agent, or Firm*—Head, Johnson & Kachigian

[57] ABSTRACT

A portable and foldable workhorse. A pair of parallel rails includes an open space between the rails, the rails providing a flat top support surface and a bottom support surface. A pair of leg assemblies each includes a top surface. A center beam is attached to each leg assembly so that each center beam is moveable in the open space between said pair of rails. A shaft passes through and perpendicular to the parallel rails and through and perpendicular to the center beam. The shaft pivotally connects each center beam to the rails to allow movement of each leg assembly between a usage position wherein the rail bottom support surface rests on the top surface of the leg assemblies and a storage position wherein the leg assemblies will move radially about a pivot point on the top rails.

7 Claims, 3 Drawing Sheets

PORTABLE AND FOLDABLE WORKHORSE

BACKGROUND OF THE INVENTION

1. Field of the Invention

The present invention is directed to a workhorse that is both foldable and portable for ease of storage and transportation. In particular, the present invention is directed to a portable and foldable workhorse wherein the leg assemblies will move between a use position wherein the top rails rest on the leg assemblies and a storage position wherein the leg assemblies will move radially about a pivot point on the top rails.

2. Prior Art

Workhorses or sawhorses are well known and are used in construction applications, used as barriers, and used in many other applications. It is advantageous that a workhorse be lightweight, be simple in design, and be portable. In the past, proposals have been made to provide workhorses which have leg assemblies that will separate from the top rails or fold under the top rails.

Examples of a folding workhorse are seen in Harter U.S. Pat. No. 2,828,165 and Boudreau U.S. Pat. No. 4,926,966.

It is advantageous to provide a workhorse that is composed of a minimum number of components. It is further desirable to provide a workhorse composed of readily available, standard size wood pieces or other readily available materials. It is also advantageous to provide a workhorse that is composed of a minimum number of metal brackets, metal hinges or other metal elements.

It is additionally desirable to provide a workhorse where the weight from the work piece is directly transmitted from the top rails to the leg assemblies.

SUMMARY OF THE INVENTION

The present invention is directed to a portable and foldable workhorse. An elongated rail assembly includes a pair of top beams or rails parallel to each other. The parallel top rails have an open space therebetween. The top rails provide a flat top support surface and an opposed, bottom support surface.

The workhorse includes a pair of leg assemblies. Each leg assembly includes a top surface which is flat and will be aligned with the bottom support surface of the rails. Each leg assembly includes a pair of legs in angular relation to each other.

A center beam is attached to and extends from each leg assembly. The center beam is juxtaposed between adjacent legs near the top surface where the legs are brought together and joined with a fastener. Each center beam is movable within the open space between the top rails.

Each center beam is attached to a brace piece. The brace piece extends between adjacent legs and is perpendicular to the center beam.

In each leg assembly, a shaft passes through and is perpendicular to an opening in the parallel rails. The shaft also passes through an opening in the center beam. The shaft, thus, pivotally connects the center beam to the rails thereby connecting the top rails to the leg assembly. The leg assemblies are thereby allowed to move about an axis formed by the shaft between a storage, folded position and a usage position.

In the usage position, the bottom support surface of the rails rests on the top surface of the leg assembly. Additionally, the top of the center beam is at the same level as the top surface of the rails. The weight of any load is, thereby, transmitted directly to the leg assemblies and also transmitted from the rails to the leg assemblies.

Each leg assembly also includes an optional lock pin which passes through the parallel rails and passes through the center beam to lock the leg assembly in the usage position.

DETAILED DESCRIPTION OF THE PREFERRED EMBODIMENTS

Figures 1, 2, 3:
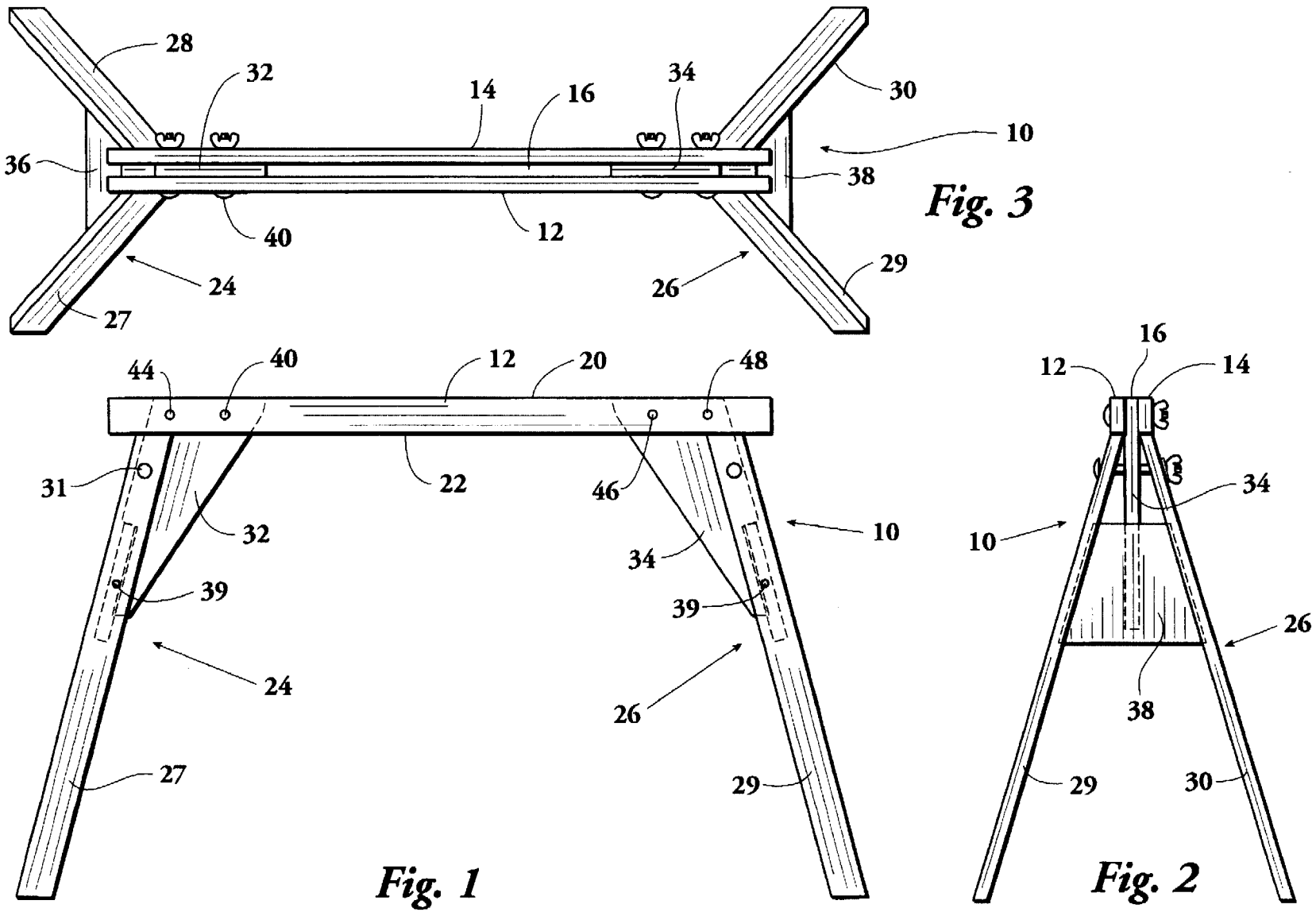
FIG. 1. is a side view of a workhorse constructed in accordance with the present invention.
FIG. 2. is an end view of the workhorse shown in FIG. 1.
FIG. 3. is top view of the workhorse illustrated in FIG. 1.

Referring to the drawings in detail, FIG. 1 illustrates a side view, FIG. 2 illustrates an end view, and FIG. 3 illustrates a top view of a portable and foldable workhorse 10 constructed in accordance with the present invention.

An elongated rail assembly includes a pair of top beams or rails 12 and 14 parallel to each other. The parallel rails 12 and 14 have an open space 16 therebetween as best seen in FIGS. 2 and 3. A single, continuous open space is provided in the embodiment shown although a series of open spaces might be employed. The top rails 12 and 14 provide both a flat top support surface 20 and an opposed, bottom support surface 22. The rails may be composed of readily available materials, such as 1"×2" wood pieces. The flat top support surface 20 receives any load, such as a work piece, to be held.

The workhorse 10 includes a pair of leg assemblies 24 and 26. While each leg assembly may be perpendicular to the rail assembly, in the present embodiment it is an obtuse angle. Each leg assembly 24 and 26 includes a top surface which is flat and, as will be seen herein, will be aligned with the bottom support surface 20 of the rails.

Each leg assembly includes a pair of legs in angular relation to each other. Leg assembly 24 includes a pair of legs 27 and 28 while leg assembly 26 includes a pair of legs 29 and 30. As best seen in FIG. 2, legs 29 and 30 are at approximately at 30° angle to each other. The legs are, likewise, fabricated from readily available materials, such as wood pieces.

A center beam 32 and 34 is attached to and extends from each leg assembly 24 and 26, respectively. The center beam 32 is juxtaposed between legs 27 and 28 near the top surface where the legs 27 and 28 are brought together and joined, in the present embodiment with fastener 31. Each center beam is parallel to the top rails 12 and 14. Each center beam is moveable in the open space 16 between the top rails. As seen in FIGS. 2 and 3, a portion of each center beam is within the open space 16.

Each center beam 32 and 34 is attached to a brace piece 36 and 38, respectively. Brace piece 36, extending between legs 27 and 28, is perpendicular to the center beam 32, while brace piece 38, extending between legs 29 and 30, is perpendicular to center beam 34. Each center beam may be notched (as seen in dashed lines in FIG. 1) to rest on and be joined to the brace piece. Fasteners 39 may be used to join the center beams to the brace pieces.

With respect to leg assembly 24, a shaft 40 passes through and is perpendicular to an opening in parallel rails 12 and 14. The shaft also passes through an opening in center beam 32. The shaft 40, thus, pivotally connects the center beam 32 to the rails 12 and 14 thereby connecting the top rails to the leg assembly 24. The shaft 40 may be composed of a bolt having threads and a wing nut, or may take other known forms. The leg assembly 24 is thereby allowed to move about an axis formed by the shaft between a storage, folded position in FIGS. 5 and 6 and the usage position shown in FIGS. 1, 2 and 3. In the usage position, the bottom support surface 22 rests on the top surface of the leg assembly 24.

As best seen in FIG. 2, the top of the center beam 32 is at the same level as the top surface 20 of the rails. The weight of any load, such as a work piece, is thereby transmitted directly to the leg assembly and also transmitted from the rails 12 and 14 to the leg assembly 24. The load on the center beam 32 is transmitted to the brace piece 36 which, in turn, is transmitted to the legs 27 and 28, providing a sturdy arrangement.

The leg assembly 24 also includes an optional lock pin 44. The removable lock pin passes through the parallel rails 12 and 14 and passes through the center beam 32. When in place, the lock pin 44 will lock the leg assembly 24 in the usage position shown in FIGS. 1, 2 and 3.

With respect to leg assembly 26, a shaft 46 passes through and is perpendicular to an opening in parallel rails 12 and 14. The shaft 46 also passes through an opening in center beam 34. The shaft 46, thus, pivotally connects the center beam 34 to the rails 12 and 14 thereby connecting the top rails to the leg assembly 26. The leg assembly is thereby allowed to move about an axis formed by the shaft between a storage, folded, position in FIGS. 5 and 6 and the usage position shown in FIGS. 1, 2, and 3. In the usage position, the bottom support surface 22 rests on the top surface of the leg assembly 26.

As best seen in FIG. 2, the top of the center beam 34 is at the same level as the top surface of the rails. The weight of any load, such as a work piece, is thereby transmitted directly to the leg assembly and also transmitted from the rails 12 and 14 to the leg assembly. The load on the center beam 34 is transmitted to the brace piece 38 which, in turn, is transmitted to the legs 27 and 28, providing a sturdy arrangement.

The leg assembly 24 also includes an optional lock pin 48. The removable lock pin 48 passes through the parallel rails 12 and 14 and passes through the center beam 34.

Figure 4:
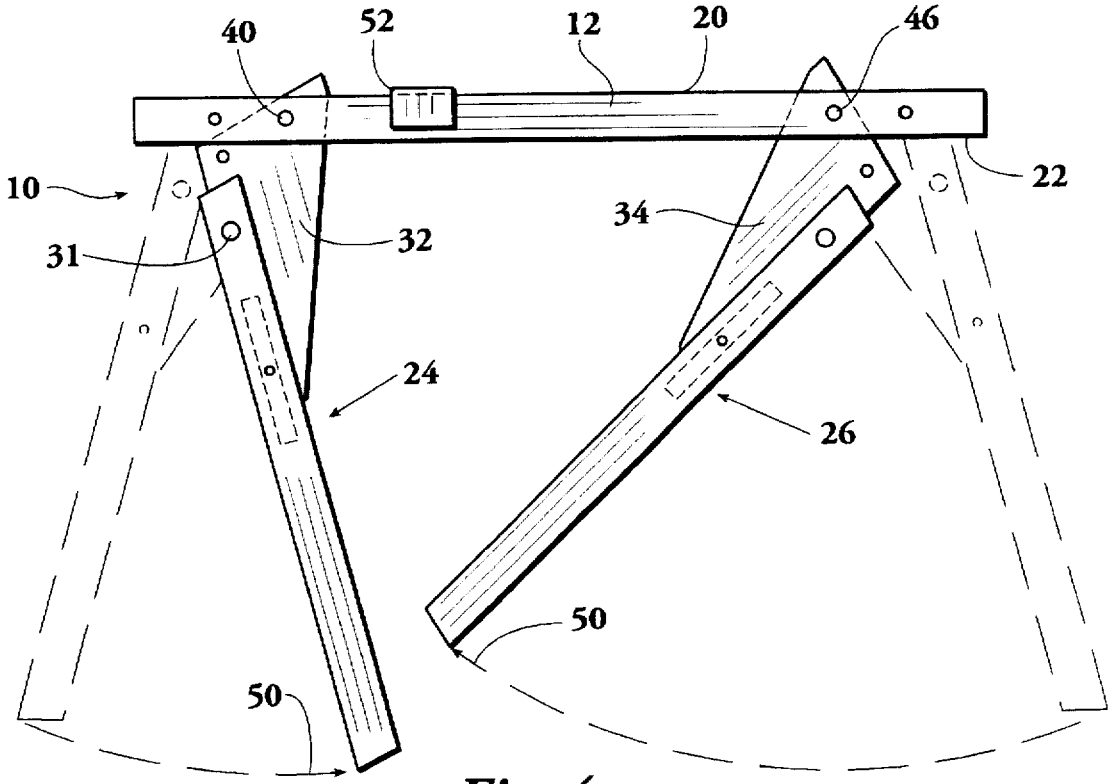
FIG. 4. a side view of the workhorse shown in FIG. 1 with the leg assemblies in movement from the usage position (in dashed lines) toward the storage position.

FIG. 4 illustrates the movement of the workhorse 10 from the usage position (with the leg assemblies 24 and 26 shown in dashed lines) toward the storage position. Leg assembly 24 will rotate radially about an axis of the shaft 40. Likewise, leg assembly 26 will rotate radially about an axis at shaft 46. Arrows 50 show the direction of movement of the leg assemblies from the usage position towards the storage position.

Figure 5:
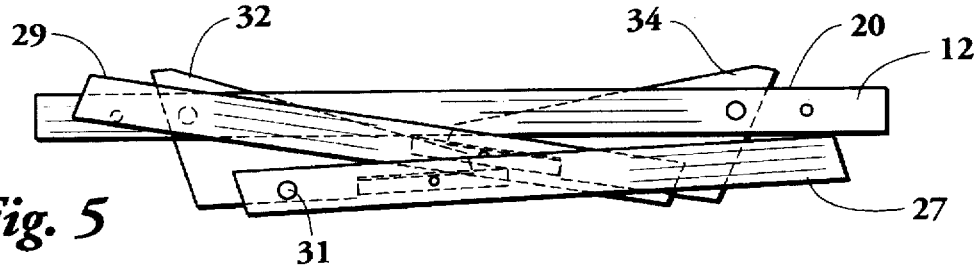
FIG. 5. is a side view
Figure 6:
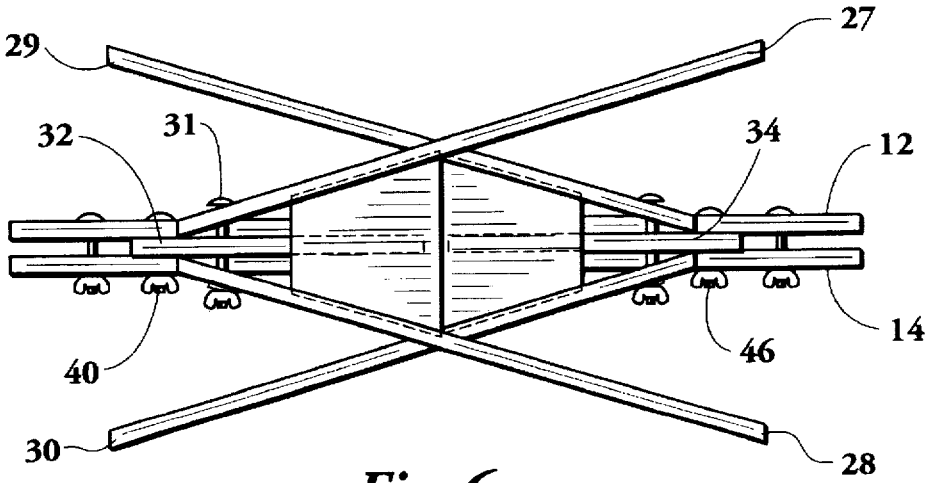
FIG. 6 is a bottom view of the workhorse shown in FIG. 1 in the storage position.

FIGS. 5 and 6 illustrate the workhorse 10 in the folded, storage position. Leg assemblies 24 and 26 are nearly parallel to the top rails 12 and 14. The workhorse 10 may be easily transported and stored.

To utilize the workhorse 10, each leg assembly 24 and 26 will be radially moved from the storage position shown in FIGS. 5 and 6 to the usage position shown in FIGS. 1, 2, and 3. The bottom support surface 22 will then be resting on the top surfaces of the leg assemblies. Thereafter, the optional lock pins 44 and 48 may be inserted through the rails and center beams.

Figure 7:
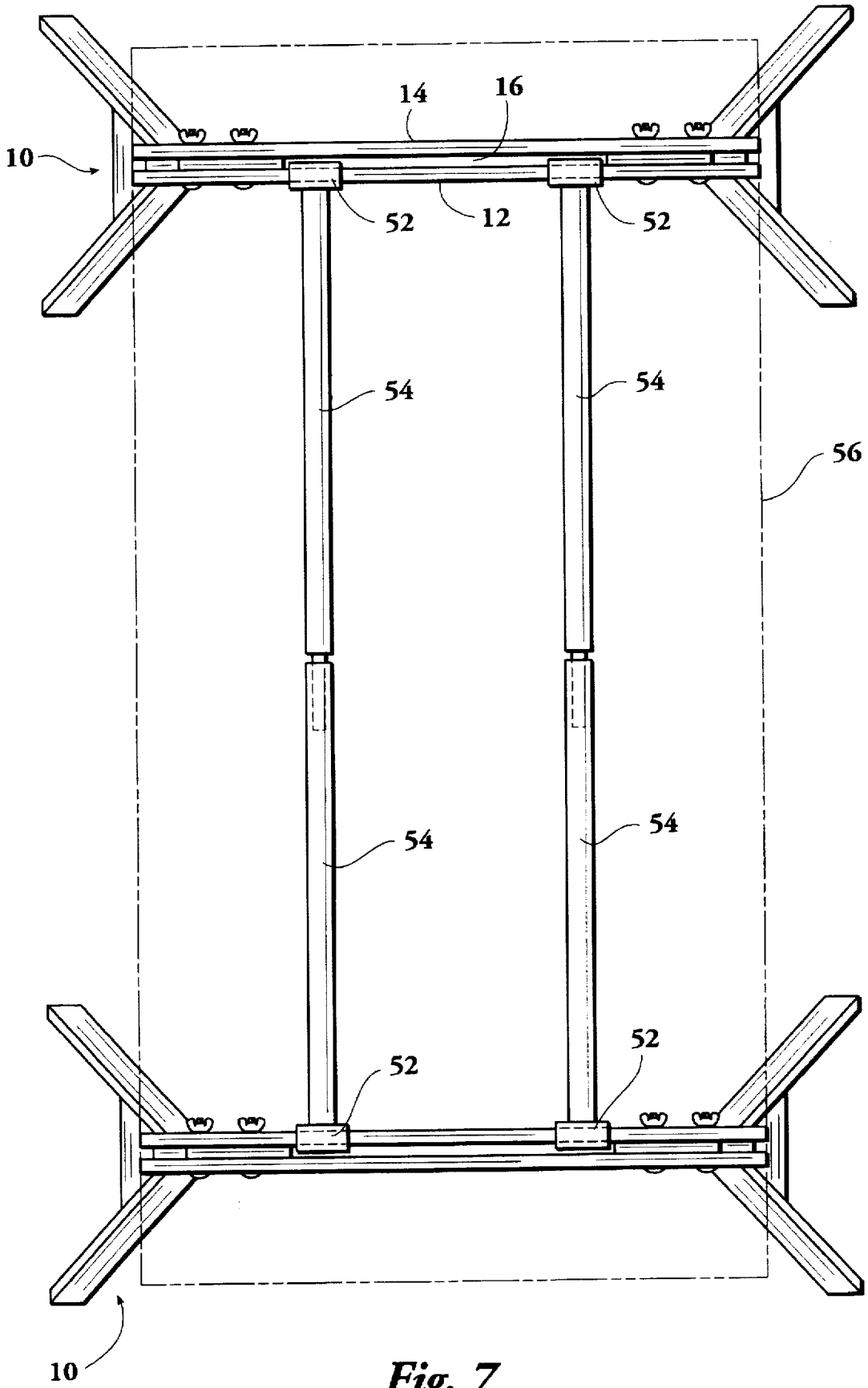
FIG. 7. is a top view of the workhorse shown in FIG. 1 connected in combination with an additional workhorse to support a load.

FIG. 7 illustrates a combination of more than one workhorse used together to hold and support a load. A hook 52 or hooks fits over one of the top rails 12 or 14. (A single hook 52 is seen in FIG. 4 for ease of comprehension). Each hook 52 provides a shelf or connection lower than the level of the top support surface. Poles 54 will connect hooks 52 on an adjoining workhorse 10 so that a platform is formed by the poles 54 and the flat top support surface 20 of the top rails 12 and 14. A sheet of plywood 56 (shown in dashed lines) is supported by the poles 54 and the top support surface of the rails. With this arrangement, more than two workhorses may be combined together.

Whereas, the present invention has been described in relation to the drawings attached hereto, it should be understood that other and further modifications, apart from those shown or suggested herein, may be made within the spirit and scope of this invention.

What is claimed is:

1. A portable and foldable workhorse, which comprises:

a pair of parallel rails having an open space between said rails, said rails providing a flat top support surface to support a load and a bottom support surface;

a pair of leg assemblies, each said leg assembly having a pair of legs that converge to form a top surface;

a center beam attached to each said leg assembly, each said center beam movable between said pair of parallel rails in said open space, each said center beam having a flat top level with said rails top support surface when in a usage position an a notched out portion;

a brace attached and perpendicular to each said center beam, each brace affixed to and extending between said pair of converging legs, each brace fitting in said notched out portion of said center beam to transmit said load to said brace; and a pair of shafts, each shaft passing through and perpendicular to said parallel rails and to said center beam, each said shaft pivotally connecting each said center beam to said rails to allow movement of each said leg assembly between a storage position wherein each said leg assembly is nearly parallel to said rails and said usage position wherein said rail bottom support surface rests on said top surfaces of said leg assemblies.

2. A portable and foldable workhorse as set forth in claim 1 including a removable lock pin for each side leg assembly, said pin passing through said parallel rails and through said center beam to lock said leg assembly in the usage position.

3. A portable and foldable workhorse as set forth in claim 1 including a hook attachable to at least one said parallel rail to provide a shelf lower than the level of said flat top support surface.

4. A portable and foldable workhorse which comprises:

an elongated rail assembly having a pair of longitudinal open spaces, a flat top support surface to support a load and a bottom support surface;

a pair of leg assemblies, each said leg assembly having a pair of legs that converge to form a top surface;

a center beam attached to each said leg assembly, each said center beam moveable in one of said longitudinal open spaces, each said center beam having a flat top level with said rail assembly top support surface and a notched out portion;

a brace attached and perpendicular to each said center beam, each brace affixed to and extending between said pair of converging legs, each brace fitting in said notched out portion of said center beam to transmit said load to said brace; and means to move each said leg assembly between a storage position wherein each said leg assembly is nearly parallel to said rails and a usage position wherein said bottom support surface rests on said top surfaces of said leg assemblies.

5. A portable and foldable workhorse as set forth in claim 4 wherein said means to move each said leg assembly includes a bolt passing through and perpendicular to said rail assembly and leg assembly.

6. A portable and foldable workhorse as set forth in claim 4 including a removable lock pin for each said leg assembly, said pin passing through said rail assembly and through said center beam to lock said leg assembly in the usage position.

7. A portable and foldable workhorse as set forth in claim 4 including a hook attachable to said rail assembly to provide a shelf lower than the level of said flat top support surface.

* * * * *

UNITED STATES PATENT AND TRADEMARK OFFICE

CERTIFICATE OF CORRECTION

PATENT NO. : 5,704,450

DATED : Jan. 6, 1998

INVENTOR(S) : Harvey LUNCEFORD

It is certified that error appears in the above-indentified patent and that said Letters Patent is hereby corrected as shown below:

Cover page, "[76] Inventor:" after Harvey Lunceford, Rt. 4, Box 1285, Stigler, Okla. 74462" insert --Gwynn W. Barnett, deceased, by and through his widow, Etta Mae Buchanan, Stigler, Okla.--.

Col. 4, line 34 (claim 1), delete "an" and insert --and--.

Signed and Sealed this

Fourteenth Day of July, 1998

Bruce Lehman

*Attest:*

BRUCE LEHMAN

*Attesting Officer*

*Commissioner of Patents and Trademarks*